US005562290A

United States Patent [19]

Wei

[11] Patent Number: 5,562,290

[45] Date of Patent: Oct. 8, 1996

[54] SHUTTLECOCK WITH LUMINESCENT MEANS

[76] Inventor: Tsung-Lu Wei, No. 137, Lane 104, Hu-Ling St., Taipei, Taiwan

[21] Appl. No.: 578,979

[22] Filed: Dec. 27, 1995

[51] Int. Cl.[6] ..... A63B 67/18

[52] U.S. Cl. ..... 273/417; 273/DIG. 24

[58] Field of Search ..... 273/417, DIG. 24

[56] References Cited

U.S. PATENT DOCUMENTS

| | | | |
|---|---|---|---|
| 3,539,794 | 11/1970 | Rauhut et al. | 273/DIG. 24 X |
| 5,018,450 | 5/1991 | Smith | 273/DIG. 24 X |

FOREIGN PATENT DOCUMENTS

| | | | |
|---|---|---|---|
| 2519558 | 7/1983 | France | 273/DIG. 24 |
| 4030640 | 4/1991 | Germany | 273/417 |
| 672430 | 11/1989 | Switzerland | 273/417 |
| 961082 | 6/1964 | United Kingdom | 273/417 |
| 92/05843 | 4/1992 | WIPO | 273/417 |

*Primary Examiner*—Paul E. Shapiro
*Attorney, Agent, or Firm*—Bacon & Thomas

[57] ABSTRACT

A shuttlecock including a feathers unit having a front coupling neck, and a light-permeable base snuggly receiving the front coupling neck of the feathers unit and defining a water-tight space, an alkaline solution filled in the water-tight space, and a film-covered luminol ball disposed in the alkaline solution, the luminol of the luminol ball is activated by the alkaline solution to produce a brilliant bluish luminescence when the luminol ball is broken by an external force being applied to the base.

3 Claims, 5 Drawing Sheets

SHUTTLECOCK WITH LUMINESCENT MEANS

BACKGROUND OF THE INVENTION

The present invention relates to shuttlecocks, and relates more particularly to such a shuttlecock which produces a brilliant bluish luminescence by means of a chemical reaction between luminol and an alkaline solution in the hollow base thereof.

Badminton is a kind of ball game suitable for people of all ages. However, when at night, the game of badminton must be played in a place where sufficient illumination is available. There is known a shuttlecock with electric light producing means which can be played during the night. However, this electric light producing means is heavy and expensive because it uses a battery cell to provide the necessary working voltage and an electronic light producing circuit to produce light. Furthermore, the electric light producing circuit tends to be damaged during the play of the game.

SUMMARY OF THE INVENTION

The present invention has been accomplished under the circumstances in view. It is one object of the present invention to provide a shuttlecock which has luminescent means that produces a brilliant bluish luminescence by means of a chemical reaction. It is another object of the present invention to provide a shuttlecock with luminescent means which has a replaceable base that can be replaced after the chemical reaction is over. According to one aspect of the present invention, the shuttlecock comprises a base defining a water-tight space, a feathers unit detachably fastened to the base, an alkaline solution filled in the water-tight space, and a film-covered luminol ball disposed in the alkaline solution, wherein the luminol of the luminol ball is activated by the alkaline solution to produce a brilliant bluish luminescence when the luminol ball is broken by an external force being applied to the base. According to another aspect of the present invention, the feathers unit comprises a front coupling neck and an outside annular groove around the periphery of the front coupling neck; the base comprises a cap-like inner shell snuggly receiving the front coupling neck of the feathers unit, the cap-like inner shell having an inside annular flange engaged with the outside annular groove of the front coupling neck of the feathers unit.

DETAILED DESCRIPTION OF THE PREFERRED EMBODIMENT

Figure 1:
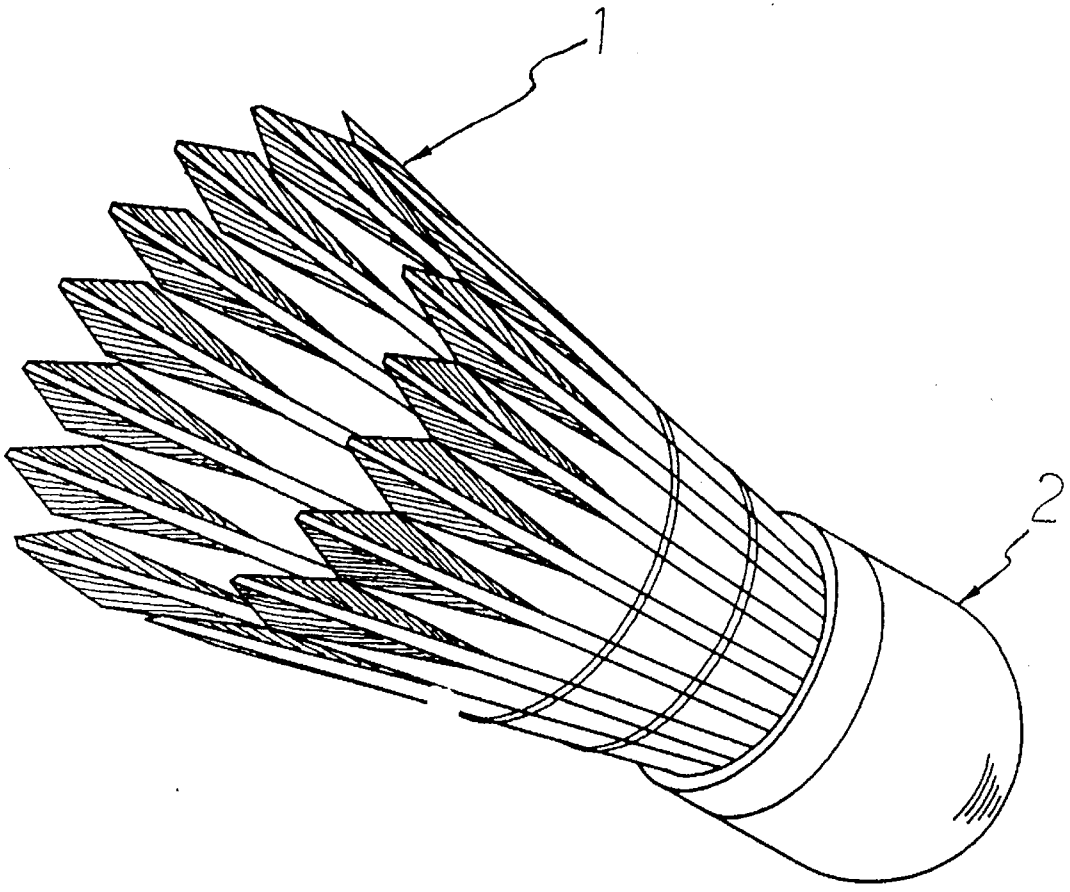
FIG. 1 is an elevational view of a shuttlecock according to the present invention.
Figure 2:
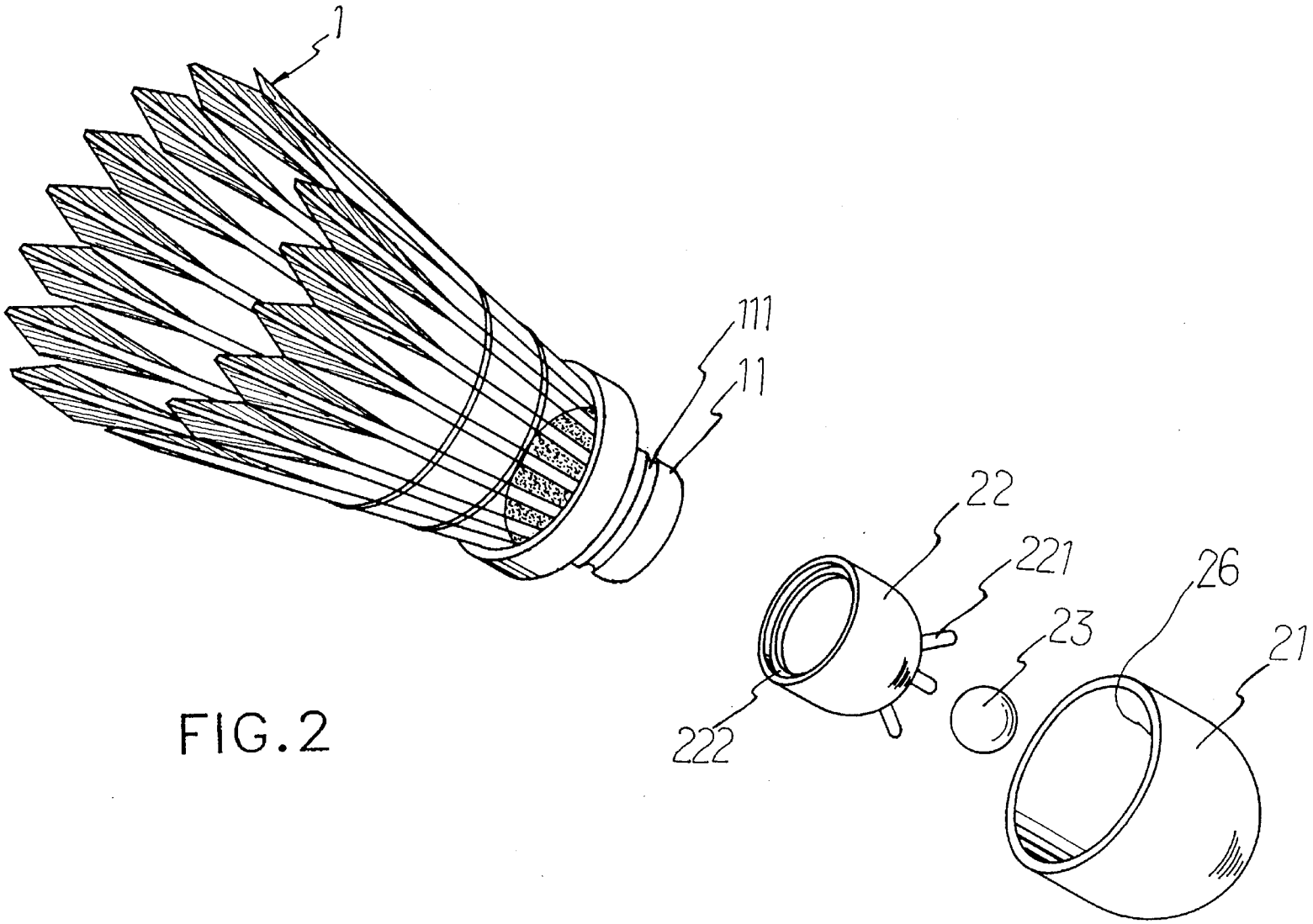
FIG. 2 is an exploded view of the shuttlecock shown in FIG. 1.

Referring to FIGS. 1 and 2, a shuttlecock is shown in accordance with the present invention, comprised of a base 2, and a feathers unit 1 detachably fastened to the base 2. The feathers unit 1 comprises a front coupling neck 11 and an outside annular groove 111 around the outside wall of the front coupling neck 11. The base 2 is comprised of an elastic, light-permeable outer cover shell 21, a cap-like inner shell 22, and a luminol ball 23 which is a mall of luminol covered with a covering of thin film. The cap-like inner shell 22 comprises an inside annular flange 222 raised around the inside wall thereof which is forced into engagement with the outside annular groove 111 of the front coupling neck 11 when the front coupling neck 11 of the feathers unit 1 is inserted into the cap-like inner shell 22, a plurality of outside projecting rods 221. The luminol ball 23 is adhered to the outside projecting rods 221 of the cap-like inner shell 22 and disposed inside the elastic outer cover shell 21. The elastic outer cover shell 21 snuggly receives the cap-like inner shell 22. A water-tight space 26 defined outside the cap-like inner shell 22 within the elastic outer cover shell 21.

Figure 3:
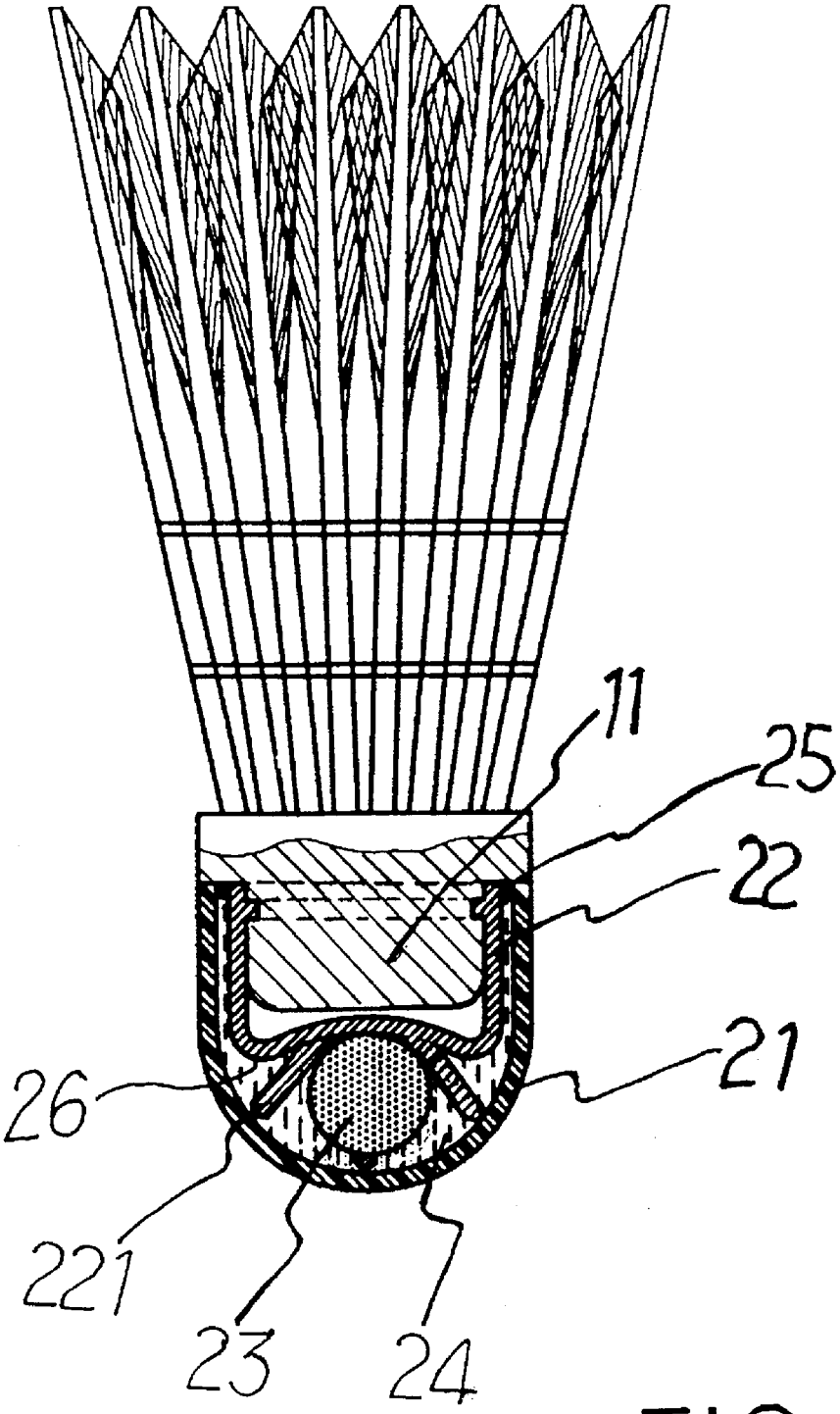
FIG. 3 is a longitudinal view in section of the shuttlecock shown in FIG. 1.

Referring to FIG. 3, when the cap-like inner shell 22 is inserted into the elastic outer cover shell 21 to hold the luminol ball 23 disposed in the water-tight space 26, an alkaline solution 24 is filled in the water-tight space 26 outside the cap-like inner shell 22 within the elastic outer cover shell 21, then the space between the cap-like inner shell 22 and the elastic outer cover shell 21 is sealed by a seal 25, and then the front coupling neck 11 of the feathers unit 1 is fastened to the cap-like inner shell 22.

Figure 4:
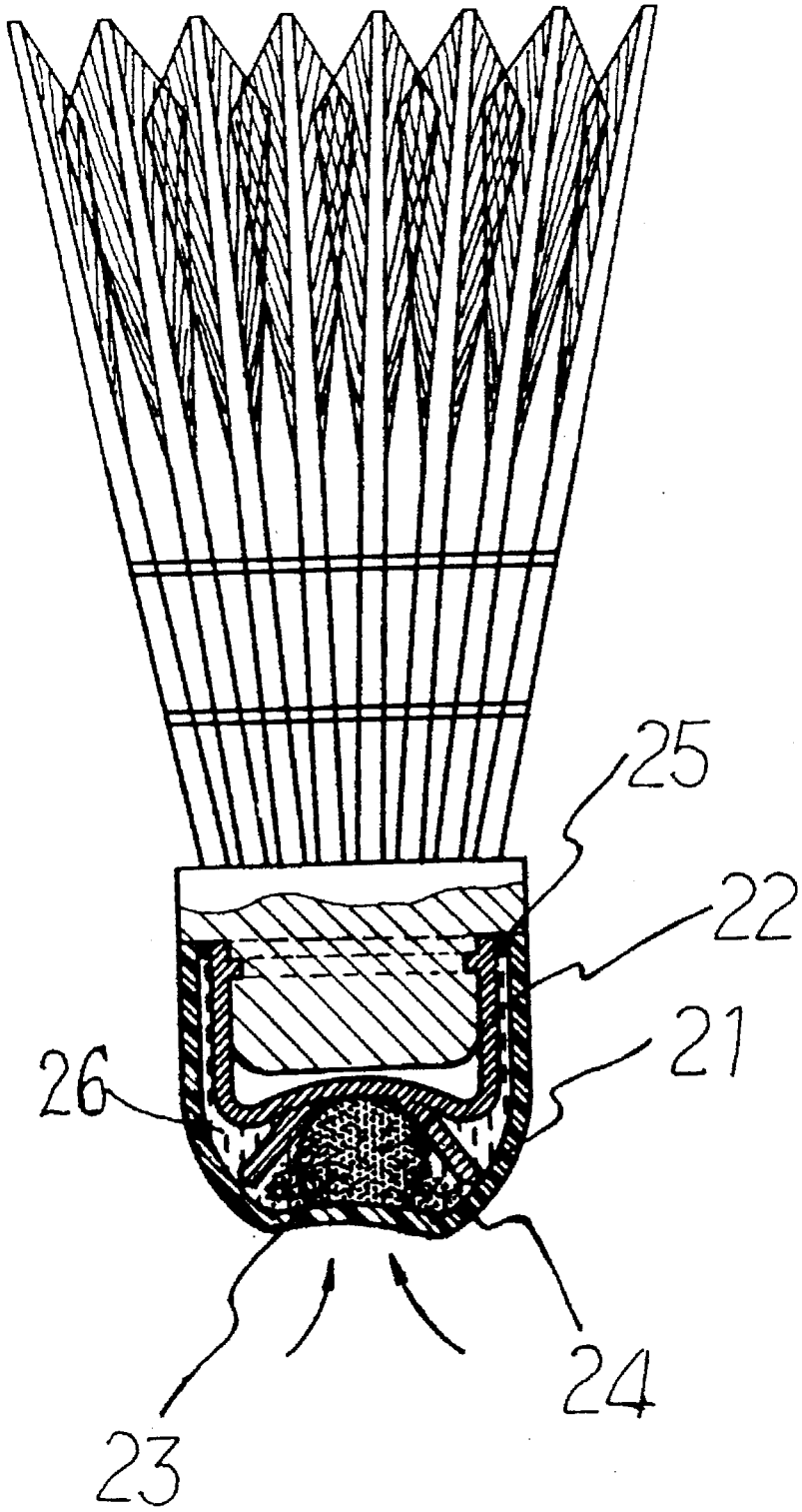
FIG. 4 is similar to FIG. 3 but showing the base depressed and the luminol ball broken.
Figure 5:
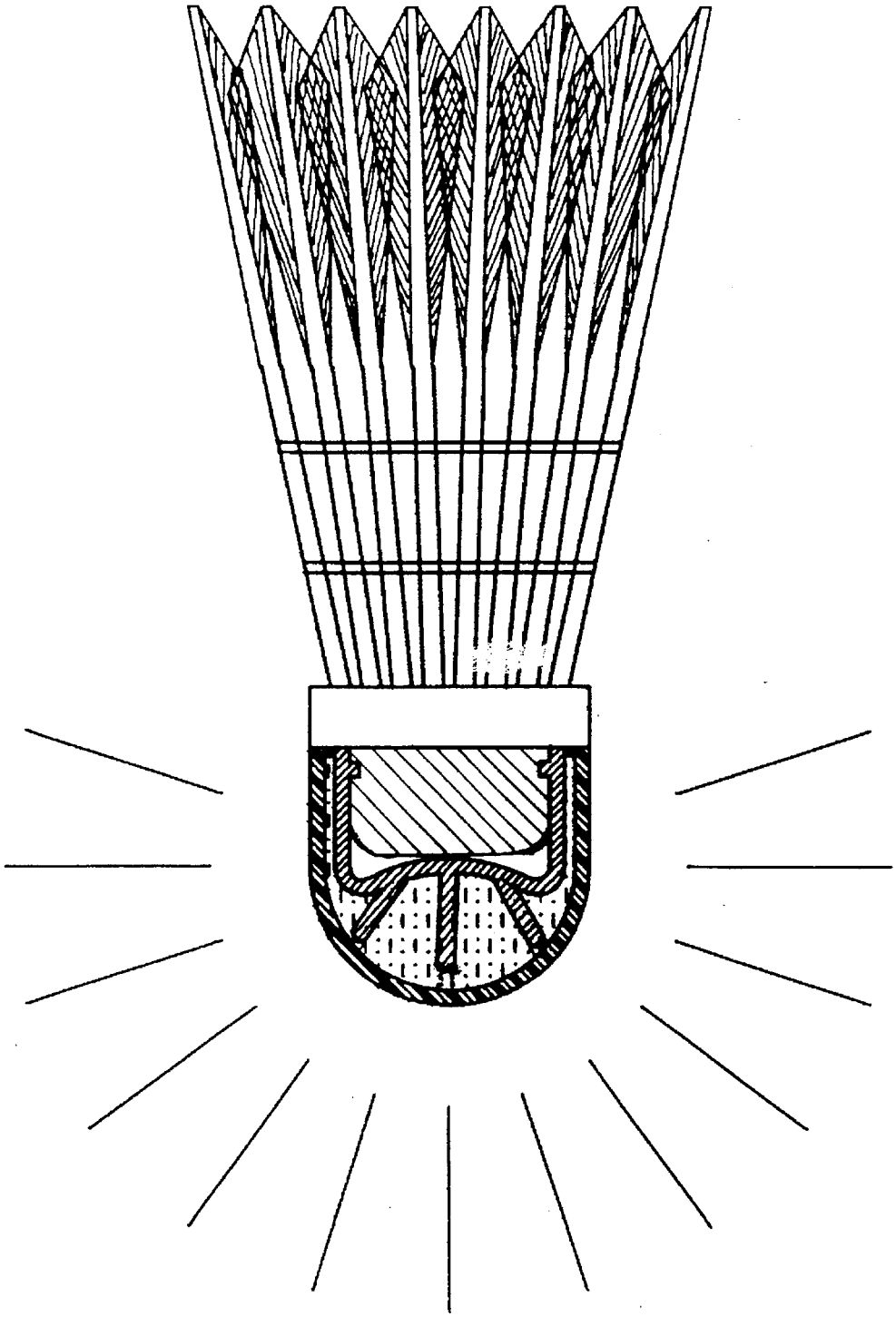
FIG. 5 shows the luminol activated by the alkaline solution, and a brilliant bluish luminescence produced according to the present invention.

Referring to FIGS. 4 and 5, when the elastic outer cover shell 21 of the base 2 is depressed against the luminol ball 23, the luminol ball 23 is broken, causing the alkaline solution to mix with luminol, and therefore a brilliant bluish luminescence is produced. When the luminescence is disappeared a certain length of time after the chemical reaction, the base 2 is detached from the feathers unit 1, and a new base 2 can be used and attached to the feathers unit 1 again.

It is to be understood that the drawings are designed for purposes of illustration only, and are not intended as a definition of the limits and scope of the invention disclosed.

I claim:

1. A shuttlecock of the type comprising a base, and a feathers unit detachably fastened to said base, wherein said base comprises an elastic, light-permeable outer cover shell, a cap-like inner shell mounted inside said elastic outer cover shell, a water-tight space defined outside said cap-like inner shell within said elastic outer cover shell, an alkaline solution filled in said water-tight space, and a luminol ball disposed in said alkaline solution inside said water-tight space, said luminol ball comprising a ball of luminol and a film covering covered on said ball of luminol to isolate it from said alkaline solution, said ball of luminol being activated by said alkaline solution to produce a brilliant bluish luminescence when said luminol ball is broken by an external force being applied to said elastic outer cover shell.

2. The shuttlecock of claim 1 wherein said feathers unit comprises a front coupling neck and an outside annular groove around the periphery of said front coupling neck; said cap-like inner shell of said base snuggly receives the front coupling neck of said feathers unit, having an inside annular flange engaged with said outside annular groove of said front coupling neck of said feathers unit.

3. The shuttlecock of claim 1 wherein said cap-like inner shell of said base comprises a plurality of outside projecting rods which hold down said luminol ball in said water-tight space.

* * * * *